US006742605B2

(12) United States Patent
Martini

(10) Patent No.: US 6,742,605 B2
(45) Date of Patent: Jun. 1, 2004

(54) PERCUSSION TOOL FOR GENERIC DOWNHOLE FLUID MOTORS

(76) Inventor: Leo A. Martini, P.O. Box 795, Edgewood, TX (US) 75117

( * ) Notice: Subject to any disclaimer, the term of this patent is extended or adjusted under 35 U.S.C. 154(b) by 0 days.

(21) Appl. No.: 10/170,509

(22) Filed: Jun. 12, 2002

(65) Prior Publication Data

US 2003/0230430 A1 Dec. 18, 2003

(51) Int. Cl.[7] ..... E21B 4/14
(52) U.S. Cl. ..... 175/57; 175/107; 175/296
(58) Field of Search ..... 175/57, 92, 197, 175/293, 296, 75, 107

(56) References Cited

U.S. PATENT DOCUMENTS 2,810,549 A * 10/1957 Morrison ..... 173/72
3,061,024 A * 10/1962 Thompson ..... 175/103
5,662,180 A * 9/1997 Coffman et al. ..... 175/57
2003/0111240 A1 * 6/2003 Karasawa et al. ..... 173/79

* cited by examiner

*Primary Examiner*—William Neuder
(74) *Attorney, Agent, or Firm*—John F. Bryan

(57) ABSTRACT

Apparatus for an improved method for drilling earthen boreholes with a fluid powered rotary motor mounted on the downhole end of a non-rotating, fluid conducting drill string has a fluid powered, axially reciprocating hammer coupled to the motor by means of a rotary coupling having freedom for axial movement, so that the hammer will be rotated by the motor and the motor will be axially isolated from the reciprocating hammer as both are powered by fluid conducted from the surface through the drill string.

14 Claims, 1 Drawing Sheet

PERCUSSION TOOL FOR GENERIC DOWNHOLE FLUID MOTORS

TECHNICAL FIELD

The present invention relates to a well drilling tool for use on hollow continuous non-rotating drill strings and in particular to a percussion tool powered by pressurized fluids supplied through the hollow drill string in combination with a generic, fluid powered rotary drilling motor.

BACKGROUND OF THE INVENTION

Downhole rotary fluid powered drilling motors of several types are in use today and others are being developed for application on non-rotating drill strings in oil well servicing and open hole earth borings. Also, there are a number of different types of surface rotated percussion drills in use today mostly in water-well drilling, blast hole drilling and the like, which have proven to be effective, especially where weight forces on the bit are limited. When downhole motors alone are used on continuous coil tubing strings, weight forces on the drill bit are limited. Also in highly deviated or horizontal wells, bit weight is limited and drill bit penetration rates are consequently reduced.

Downhole percussion tools are presently used on surface rotated drill strings, where the extended length of tubing "winds-up" as a spring, under torsional loading. This quick reacting "wound-up" torque discourages axial slip in a splined connection, while at the same time, the elasticity and inertia of the long drill stem soften the sharp hammer blows and would otherwise break loose the static spline friction. Thus, a surface rotary drive is never adequately isolated from the axial hammering of a downhole percussion tool.

Presently several types of fluid powered downhole rotary motors are in use and others are being developed for drilling with non-rotating drill strings. Among these are the Moineau progressive cavity type, such as covered by patents U.S. Pat. Nos. 6,241,494 BI and 4,676,725. Experimental and limited usage motors such as the roller rod vane type of patents U.S. Pat. Nos. 5,785,509, 5,833,444, and 5,302,666 BI are other examples of such downhole motors. Yet other examples are the geared vane and geared turbine type of downhole motors described in Martini U.S. Pat. No. 6,520,271. For the purposes of this disclosure, all of these drilling motor types are considered generic as related to the present invention.

Therefore, a first object of the present invention is to provide a percussive tool for use in combination with existing gas powered, rotary drilling motors. A second object of the invention is to provide increased drill penetration rates, particularly with non-rotating drill strings and where bit weight is limited and yet a third object is to achieve effective motor isolation from percussive shock.

SUMMARY OF THE INVENTION

The present invention is an automatic fluid powered, reciprocating mass, percussion drilling tool adapted to drive a drill bit forward in sustained repetition when coupled with a generic fluid driven rotary motor so as to enhance the drilling operation in accordance to the afore stated objects. The industry is moving to increased usage of fluid powered downhole motors for bit rotation instead of surface drill string rotation and inasmuch as percussion drilling has proven to be effective, the present invention provides a means for adding the benefits of percussion drilling to such pre-existing drill motors.

The apparatus of the present invention provides for an improved method for drilling earthen boreholes with a fluid powered rotary motor mounted on the downhole end of a non-rotating, fluid conducting drill string. The central shaft of a fluid powered, axially reciprocating hammer is coupled to the motor by means of a rotary coupling having freedom for axial movement, so that the hammer will be rotated by the motor and the motor will be axially isolated from the reciprocating hammer. The percussion hammer comprises a reciprocating mass, in the form of an annular piston operating on the central shaft to impact the drilling bit on its down stroke. The motor is powered by fluid conducted from the surface through the drill string according to the well known practice of prior art. In the present invention however, drilling fluid discharged from the motor is utilized at lower pressure for and controlled by valving ports integral to the central shaft so as to power reciprocation of the piston. Upon discharge from the percussion hammer, the drilling fluid circulates through the bit to flush the borehole and carry the cuttings up the annulus around the the drill string to the well surface.

The present invention eliminates the extended drill string length between the surface motor and the percussion tool, so as to eliminate the quick reacting wound-up forces and axial forces which otherwise conspire to inhibit motor isolation. Thus, the percussive blows reach the splined coupling with a sharpness that overcomes static friction in the splines of a connecting coupling coupling and a heretofore unrealized degree of motor isolation is achieved.

Since the output torque and rotational speed of the generic motors varies with the particular design, operational pressure and other factors, the percussion hammer should be sized, tuned and made suitable for the characteristics of each motor as well as the field application. For example a higher speed lower torque output motor would require a relatively light, higher frequency hammer to bit impact while a higher torque lower speed motor could have a higher hammer to bit impact.

DETAILED DESCRIPTION

This specification discloses an automatic bit hammering tool 100 for use in cooperation with a generic fluid powered well drilling motor. It has been demonstrated that impacting a drill bit during rotation will increase the penetration rate of the drilling operation. The motor is powered by drilling fluid supplied through the drill string, and may be any suitable drilling motor having an axial downward extending output shaft. The drilling fluid commonly used in the oil field is highly pressurized nitrogen. The drilling fluid first powers the rotation of the motor and, after bring discharged from the motor, powers the reciprocating percussion tool of the present inventions. Thus, the motor and percussion tool are each powered by a differential pressure drop, with each consuming a portion of the total pressure energy supplied. Both differential pressure drops are well within common oil field pressure capabilities even at very deep well depths.

Figure 3:
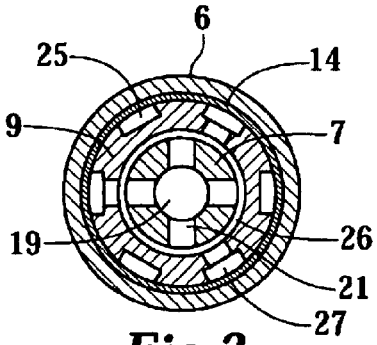
FIG. 3 is a cross section view taken at line 3—3 of FIG. 1.
Figure 2:
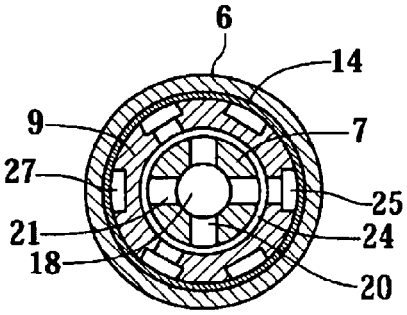
FIG. 2 is a cross section view taken at line 2—2 of FIG. 1.
Figure 4:
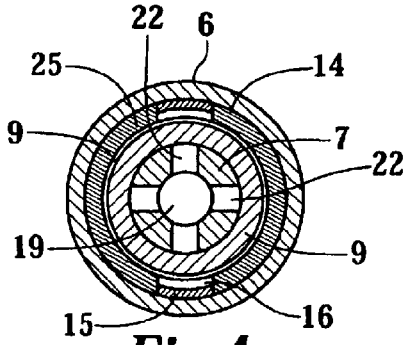
FIG. 4 is a cross section view taken at line 4—4 of FIG. 1.
Figure 1:
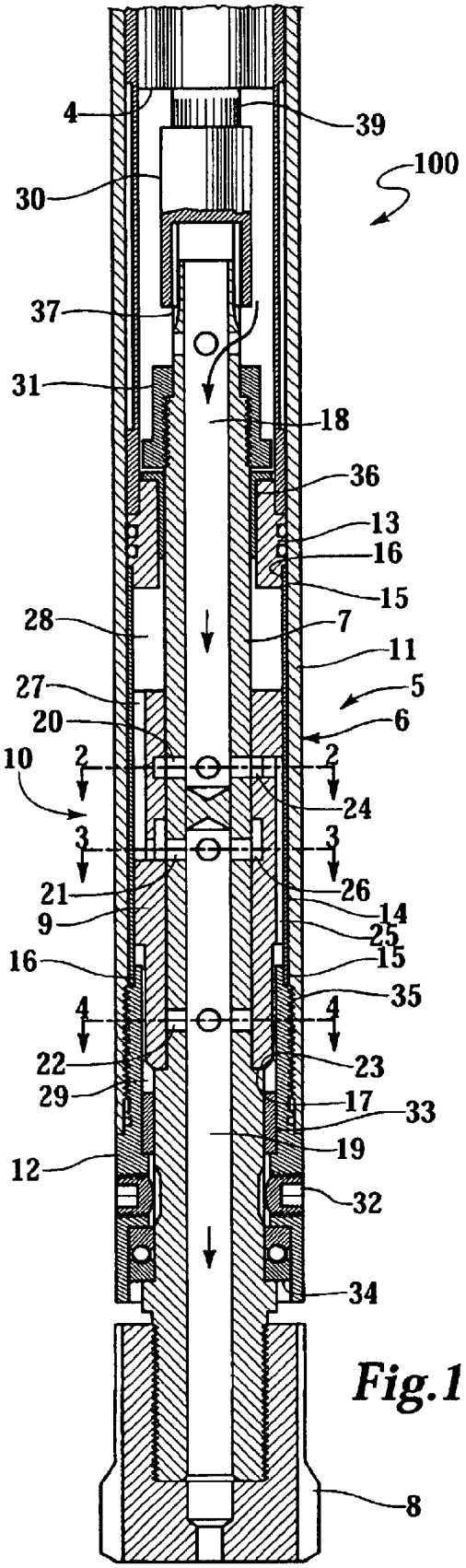
FIG. 1 is a center vertical section view of the lower end of a fluid powered drilling motor showing the bearing mounted rotary output shaft with drill bit, reciprocal piston and the ports and passages of the valving arrangement.

FIG. 1 shows a preferred embodiment 100 of the percussion tool 5, comprising housing 6, bearing mounted rotary shaft 7, with drill bit 8, reciprocal piston 9 and automatic valving arrangement 10. The housing is made up of barrel 11, bottom sub 12, middle sub 13 and sleeve 14 all in fixed relation. Sleeve 14 is close fitted to inside of barrel 11 and has extended lugs 15 on both ends to fit in recesses 16 of bottom sub 12 and middle sub 13. Bottom sub 12 has sleeve bearing 33 and thrust bearing 34 for supporting shaft 7, means for locking shaft 7 against rotation and is attached to barrel 11 by threaded connection 35.

Motor 4, which may be a low-speed, high torque motor or may be a high speed motor and include a geared reduction, is mounted in barrel 11, with output shaft 39 connected to rotary shaft 7 by splined coupling 30. Shaft 7 is also supported by flanged sleeve bearing 36 at its upper end in middle sub 13. On its upper end 37, shaft 7 fits coupling 30 for transmitting rotary motion and torque from motor 4 and isolates the motor from the axial percussive movements of shaft 7. Coupling 30 may be internally splined for a slip fit with shaft end 37 or be of a coupling type that allows longitudinal shaft displacements. Also shaft 7 has a stepped impact receiving shoulder 17 intermediate its ends, fluid passageway 18 extending from the upper end to cross ports 20, fluid passageway 19 extending upward from the lower end to intersect with cross ports 21 and 22. Fluid passageway 19 also serves to conduct fluid to the face of the drilling bit for flushing cuttings away from the borehole bottom and up the annulus between the drill string and the borehole. Shouldered retaining nut 31 just below shaft upper end 37 contacts the flange of sleeve bearing 36 to restrain shaft 7 against falling from the assembly.

Piston 9 is made for a sliding fit with sleeve bearing 14 on its outside diameter and also with shaft 7 on its inside diameter, These sliding fits are close enough to provide sealing for movement of piston 9 under drilling fluid pressure. Chamber 28 above piston 9 and chamber 29 below piston 9 are alternately pressurized by valving arrangement 10 to provide fluid driven axial reciprocation. Surface 23 at the lower end of piston 9 strikes against shoulder 17 of shaft 7 on each piston cycle. Piston 9 has upper annulus 24, with fluid passageway 25 connecting to the lower end of piston 9 and chamber 29 and lower annulus 26 with fluid passageway 27 communicating with the upper end of piston 9 and chamber 28.

The valving arrangement 10 for piston 9 reciprocation consists of ports 20, 21 and 22 of shaft 7 cooperating with upper annulus 24 lower annulus 26 and the impact against piston end surface 23 to produce self sustaining piston reciprocation. When piston 9 is at the downward end of its reciprocating travel, ports 20 are aligned with upper annulus 24 so as to direct fluid to chamber 29 and drive piston 9 upwards. When piston 9 is at the upward end of its reciprocating travel, ports 21 are aligned with lower annulus 26 so as to direct fluid to chamber 28 and drive piston 9 back downwards.

The piston 9 cycle start and end position is shown in FIG. 1 where at the end of its down stroke strikes the shaft 7 shoulder 17 for inertial energy transfer and the valving arrangement 10 ports and passages are aligned for pressure charging chamber 29; for accelerating piston 9 upward; and for exhausting chamber 28 above the piston. As piston 9 travels upward it reaches a position where valving arrangement 10 exhausts fluid from chamber 29 through port 22 and simultaneously pressurizes chamber 28 above piston 9 with a compressible cushion of gas, which is trapped in chamber 28. On the down stroke of piston 9, valving arrangement 10 further charges chamber 28 for added piston acceleration. Near the end of piston 9 down stroke, valving arrangement 10 exhausts chamber 28 through annulus 26 and ports 21. Simultaneously, through annulus 24 and ports 20, chamber 29 is pressurized for immediate, piston acceleration upward after surface 23 strikes shaft shoulder 17 for a percussive blow that is transferred to bit 8. Thus, ends one piston reciprocation cycle of piston 9. Cycle frequency will vary from high to low as a function of drilling fluid supply pressure downstream from motor 4. Screws 32 in bottom sub 12 are provided to be adjusted inwardly to engage recesses 33 so as to lock shaft 7 for changing bits.

The embodiments shown and described above are exemplary. It is not claimed that all of the details, parts, elements, or steps described and shown were invented herein. Even though many characteristics and advantages of the present inventions have been described in the drawings and accompanying text, the description is illustrative only. Changes may be made in the detail, especially in matters of shape, size, and arrangement of the parts within the scope and principles of the inventions. The restrictive description and drawings of the specific examples above do not point out what an infringement of this patent would be, but are to provide at least one explanation of how to use and make the inventions. The limits of the inventions and the bounds of the patent protection are measured by and defined in the following claims.

What is claimed is:

1. A method for drilling earthen boreholes with a non-rotating, fluid conducting drill string comprising the steps of:

providing a fluid powered rotary drilling motor;

connecting the drilling motor to the downhole end of the drill string;

providing a fluid powered, axially reciprocating hammer;

providing a rotary coupling with freedom for axial movement connecting the reciprocating hammer to the downhole end of the motor with the coupling, so that the hammer will be rotated by the motor and the motor will be axially isolated from the hammer;

connecting a drill bit in rigid assembly with the downhole end of the reciprocating hammer so that the action of the drill bit will be both rotating and axially reciprocating, supplying fluid through the drill string;

rotating the motor with fluid supplied through the drill string; and reciprocating the hammer with fluid discharged from the motor.

2. The method of claim 1, wherein the step of reciprocating further comprises:

providing a central shaft and cooperating annular piston mass;

porting fluid from the motor to the lower end of the piston for driving the piston upwardly; and porting fluid from the motor to the upper end of the piston for driving the piston downwardly.

3. The method of claim 2, wherein the step of reciprocating further comprises cushioning the upwardly driven piston by trapping fluid above the piston.

4. The method of claim 2, wherein the step of reciprocating further comprises impacting the downwardly moving piston against the central shaft.

5. Apparatus for drilling earthen boreholes with a non-rotating, fluid conducting drill string, comprising:

a fluid powered rotary motor mounted on the downhole end of the drill string to receive fluid for rotation;

a fluid powered, axially reciprocating hammer having a central shaft;

a tubular housing connected with the drill string;

a reciprocating annular piston mass slip fitted to operate inside of the tubular and on the central shaft;

a rotary coupling with freedom for axial movement connecting the upper end of the central shaft to the downhole end of the motor with the coupling, so that the central shaft will be rotated by the motor but axially isolated therefrom;

at least one port to conduct fluid from the drilling string to the upward end of the piston, for moving the piston downwardly;

at least one port to conduct fluid from the drilling string to the downward end of the piston, for moving the piston upwardly;

a drill bit rigidly connected to the downhole end of the central shaft; and a fluid passageway supplying fluid from the drill string to the drill bit.

6. The apparatus of claim 5, and further comprising a chamber above the piston arranged to trap fluid so as to cushion the end of upward piston movement.

7. The apparatus of claim 5, wherein the central shaft further comprises an impact surface arranged to stop the piston at the end of downward movement.

8. An improved apparatus for drilling earthen boreholes with a fluid powered rotary motor mounted on the downhole end of a non-rotating, fluid conducting drill string, wherein the improvement comprises:

a fluid powered, axially reciprocating hammer having a central shaft;

a tubular housing connected with the drill string;

a reciprocating annular piston slip fitted to operate inside of the tubular and on the central shaft;

a rotary coupling with freedom for axial movement connecting the upper end of the central shaft to the downhole end of the motor with the coupling, so that the central shaft will be rotated by the motor and yet axially isolated therefrom;

at least one port to conduct fluid from the drilling string to the upward end of the piston, for moving the piston downwardly;

at least one port to conduct fluid from the drilling string to the downward end of the piston, for moving the piston upwardly;

a drill bit rigidly connected to the downhole end of the central shaft; and a fluid passageway supplying fluid from the drill string to the drill bit.

9. The apparatus of claim 8, and further comprising; a chamber arranged to trap fluid above the piston so as to cushion the end of upward piston movement.

10. The apparatus of claim 8, wherein the central shaft further comprises an impact surface arranged to stop the piston at the end of downward movement.

11. An improved method for drilling earthen boreholes with a fluid powered rotary motor mounted on the downhole end of a non-rotating, fluid conducting drill string, wherein the improvement comprises the steps of:

providing a fluid powered, axially reciprocating hammer;

providing a rotary coupling with freedom for axial movement connecting the reciprocating hammer to the downhole end of the motor with the coupling, so that the hammer will be rotated by the motor and the motor will be axially isolated from the hammer;

connecting a drill bit in rigid assembly with the downhole end of the reciprocating hammer so that the action of the drill bit will be both rotating and axially reciprocating, supplying fluid through the drill string;

rotating the motor with fluid supplied through the drill string; and reciprocating the hammer with fluid discharged from the motor.

12. The method of claim 11, wherein the step of reciprocating further comprises:

providing a central shaft and cooperating annular piston porting fluid from the motor to the lower end of the piston for driving the piston upwardly; and porting fluid from the motor to the upper end of the piston for driving the piston downwardly.

13. The method of claim 12, wherein the step of reciprocating further comprises cushioning the upwardly driven piston by trapping fluid above the piston.

14. The method of claim 12, wherein the step of reciprocating further comprises impacting the downwardly moving piston against the central shaft.

* * * * *